US012687009B2

(12) United States Patent
Wells

(10) Patent No.: US 12,687,009 B2
(45) Date of Patent: Jul. 21, 2026

(54) MODULAR BUILDING CONSTRUCTION SYSTEM

(71) Applicant: Merit Group Services Limited, Northumberland (GB)

(72) Inventor: Anthony Wells, Northumberland (GB)

( * ) Notice: Subject to any disclaimer, the term of this patent is extended or adjusted under 35 U.S.C. 154(b) by 224 days.

(21) Appl. No.: 18/192,689

(22) Filed: Mar. 30, 2023

(65) Prior Publication Data

US 2024/0328147 A1 Oct. 3, 2024

(51) Int. Cl.
*E04B 1/348* (2006.01)

(52) U.S. Cl.
CPC ..... *E04B 1/34861* (2013.01); *E04B 1/34869* (2013.01); *E04B 1/3483* (2013.01)

(58) Field of Classification Search
CPC ..... E04B 1/34869; E04B 1/34861; E04B 1/3483; E04H 5/02
USPC ..... 52/79.8
See application file for complete search history.

(56) References Cited

U.S. PATENT DOCUMENTS

| | | | | |
|---|---|---|---|---|
| 5,265,384 | A | 11/1993 | Menke et al. | |
| 9,795,061 | B2 * | 10/2017 | Roy | H05K 7/20827 |
| 9,795,957 | B2 * | 10/2017 | Holtz | B01L 1/04 |
| 9,945,142 | B2 * | 4/2018 | Maselli | E04H 5/02 |
| 10,888,034 | B2 * | 1/2021 | Roy | H05K 7/20827 |
| 11,606,877 | B2 * | 3/2023 | Roy | H05K 7/20827 |
| 2002/0189173 | A1 * | 12/2002 | Staschik | F02G 1/043 52/79.1 |
| 2012/0255710 | A1 * | 10/2012 | Maselli | E04H 5/02 165/80.2 |
| 2014/0053599 | A1 * | 2/2014 | Byfield | F25J 1/0022 29/890.035 |
| 2016/0010884 | A1 * | 1/2016 | Holtz | F24F 8/00 454/187 |
| 2019/0277020 | A1 * | 9/2019 | Ahern | F24F 7/065 |
| 2020/0040594 | A1 * | 2/2020 | Hedberg | E04H 1/005 |

(Continued)

FOREIGN PATENT DOCUMENTS

| | | | |
|---|---|---|---|
| CN | 111561191 | A | 8/2020 |
| CN | 111648477 | A | 9/2020 |
| EP | 2464913 | A | 8/2010 |

(Continued)

OTHER PUBLICATIONS

Search Report: Intellectual Property Office; Great Britain; Search Report; Jul. 4, 2024.

(Continued)

*Primary Examiner* — Paola Agudelo
(74) *Attorney, Agent, or Firm* — Patshegen IP; Moshe Pinchas

(57) ABSTRACT

A modular building construction system for fabricating a facility 102 comprising a plurality of primary function modules 104, each primary function module configured to house equipment for a primary function; at least one transition module 106 configured to cooperate with at least two of the plurality of primary function modules 102 in order to allow people to move from at least one of the primary function modules 104 to at least one other of the primary function modules 104 via the transition module 106, and a support module 108 configured to house equipment for supporting the primary function modules 104 and the at least one transition modules 106.

15 Claims, 16 Drawing Sheets

(56) References Cited

U.S. PATENT DOCUMENTS

2021/0047828 A1* 2/2021 Williams ..... E04H 5/02

FOREIGN PATENT DOCUMENTS

| | | | |
|---|---|---|---|
| EP | 3456903 | A1 | 3/2019 |
| EP | 3480380 | A1 | 5/2019 |
| FR | 3017406 | A | 2/2014 |
| KR | 2006 0072762 | A | 6/2006 |
| WO | 2009/098483 | A | 8/2009 |
| WO | 2011022325 | A2 | 2/2011 |
| WO | 2022087674 | A1 | 5/2022 |

OTHER PUBLICATIONS

EPO Search Report; The Hague; Apr. 25, 2022.
Intellectual Property Office; Great Britain; Search Report; Apr. 14, 2023.
Intellectual Property Office; Great Britain; Search Report; Jul. 2, 2021.

* cited by examiner

MODULAR BUILDING CONSTRUCTION SYSTEM

TECHNICAL FIELD

The present invention relates to a modular building construction system for fabricating a facility and particularly, but not exclusively, relates to a modular building construction system for fabricating a laboratory facility, a medicinal product manufacturing facility, a medical facility, a cleanroom facility or similar.

BACKGROUND

The construction industry is known to have a chronically low level of productivity that has changed very little in the past seventy years. It is thought that the low level of productivity is a consequence of the generally accepted need for bespoke buildings to be developed for particular applications combined with 'tried-and-tested' construction methods.

Bespoke buildings typically take several years to design, construct and validate/qualify which is slow and by implication costly. Furthermore, building designs are also often subject to changes as a project progresses and, in some circumstances, buildings have to be further modified after completion in order to comply with a change in requirements, expansion or cost constraints.

The problem is particularly acute for research and medical facilities which often need to be constructed rapidly and which must be flexible to accommodate changes to their end use. For example, laboratory facilities such as vaccine development facilities, advanced therapy medicinal product facilities and cell and gene therapy facilities are often planned and then initiated very quickly, with a need for them to be constructed and commissioned in several months rather than several years and to be adaptable during and after construction.

In addition, once a building has been constructed, it is typically time consuming and costly to install service networks, such as ventilation systems, piping networks and electrical networks, in the building.

There is a need for a better way of constructing buildings which is rapid, low cost and flexible.

SUMMARY OF THE INVENTION

According to a first aspect of the invention there is provided A modular building construction system for fabricating a facility comprising a plurality of primary function modules, each primary function module configured to house equipment for a primary function; at least one transition module configured to cooperate with at least two of the plurality of primary function modules in order to allow people to move from at least one of the primary function modules to at least one other of the primary function modules via the transition module, and a support module configured to house equipment for supporting the primary function modules and the at least one transition modules.

Equipment for supporting the primary function modules and the at least one transition module is service equipment such as a ventilation and air conditioning system, a fluid source, an electricity source and/or other source of a service which is supplied to one or more of the primary function modules and/or the transition modules to support its function, such as to facilitate habitation or operation, such as operation as a laboratory facility.

Each primary function module may comprise a framework having a plurality of openings and which is configured to provided structural rigidity for the primary function module.

Each primary function module may further comprise panels which attach to the framework and are configured to provide occlude the openings in the framework.

Each primary function module may be configured to receive at least one preassembled service module comprising at least one of ventilation ducting, an electrical cable tray, and piping for supply of at least one fluid to the primary function module.

Each primary function module may be configured such that the preassembled service module is mounted at the ceiling of the primary function module.

The framework may comprise lateral beams configured such that the preassembled service module is secured to the lateral beams such that it is suspended from the lateral beams.

The primary function module may be configured to be stacked one above the other.

Each primary function module may be a laboratory module.

The support module may be a plant room module configured to house plant machinery.

The plant machinery may comprises a heating, ventilation and air conditioning (HVAC) system.

The heating, ventilation and air conditioning (HVAC) system may be a once-through heating, ventilation and air conditioning (HVAC) system having heat recovery.

Each of the primary function modules, the transition module and the support module may be fabricated from uprights, beams and panels having standard dimensions.

The panels may comprise a material certified for a cleanroom application.

Each module may have a length not greater than 20 m, a width not greater than 5 m and a height not greater than 4.2 m.

According to a second aspect of the invention there is provided a facility comprising: a plurality of primary function modules, each primary function module is configured to house equipment for a primary function; at least one transition module connected with at least two of the plurality of primary function modules such that people are able to move from at least one of the primary function modules to at least one other of the primary function modules via the transition module, and a support module configured to house equipment for supporting the primary function modules and the at least one transition modules.

The facility may comprise a first floor having at least one primary function module, at least one transition module and at least one support module which houses equipment arranged to support the at least one primary function module and the at least one transition module, and a second floor having at least one primary function module, at least one transition module and at least one support module which houses equipment arranged to support the at least one primary function module and the at least one transition module.

The facility may further comprise at least one preassembled service module comprising at least one of ventilation ducting, an electrical cable tray, and piping for supply of at least one fluid to the primary function module.

The at least one preassembled service module may be not greater than 6 m in length.

According to a third aspect of the invention there is provided a method of assembling a facility comprising the steps: providing a plurality of primary function modules, each primary function module configured to house equipment for a primary function; connecting at least one transition module with at least two of the plurality of primary function modules in order to allow people to move from at least one of the primary function modules to at least one other of the primary function modules via the transition module, and connecting at least one support module configured to house equipment for supporting the primary function modules and the at least one transition modules to at least one of the primary function modules and/or the at least one transition module.

Each of the primary function modules, the at least one transition module and the at least one support module is fabricated remotely from a site at which the facility is assembled, and subsequently transported to the site for assembly with the other of said primary function, transition and support modules.

According to a fourth aspect of the invention there is provided a module for use in a modular building construction system comprising: a framework having a plurality of openings and which is configured to provided structural rigidity for the primary function module; panels which attach to the framework and are configured to provide occlude the openings in the framework, and at least one preassembled service module comprising at least one of ventilation ducting, an electrical cable tray, and piping for supply of at least one fluid to the primary function module, wherein the framework comprises lateral beams and the preassembled service module is secured to the lateral beams such that it is suspended from the beams.

According to a fifth aspect of the invention there is provided a method of constructing a facility at a predetermined site comprising the steps: providing a building structure at a predetermined site, the building structure having a plurality of primary function rooms and at least one transition room configured to allow people to move from at least one of the primary function rooms to at least one other of the primary function rooms via the at least one transition room; fabricating a support module remote from the predetermined site, wherein the support module is configured to house equipment for supporting the primary function rooms and the at least one transition room; transporting the support module to the predetermined site, and joining the support module to the building structure.

The method may further comprise the step of cladding the building structure and the support module with a cladding arrangement such that the building structure and the support module create an appearance of an integrated facility.

Equipment for supporting the primary function rooms and the at least one transition room is disposed within the support module. The equipment may be disposed in the support module during fabrication of the support module, after transporting of the support module to the predetermined site and before joining the support module to the building structure or after joining of the support module to the building structure.

The building structure may comprise at least one service network and the step of joining the support module with the building structure comprises connecting the equipment with at least one service network of the building structure.

The equipment may comprise a heating, ventilation and air conditioning (HVAC) system and the service network comprises a ventilation network.

The support module may be joined to the building structure such that it is disposed externally of the building structure.

Various further features and aspects of the invention are defined in the claims.

Certain aspects of the invention provide a modular construction system which allows for a bespoke facility to be designed in a way that significantly reduces design and construction time and costs, but which retains the individuality of design that traditional modular construction systems are unable to provide.

Certain aspects of the invention provide a modular construction system that allow for a significant proportion of construction work to be done offsite (i.e. away from the site at which a facility is located).

Certain aspects of the invention provide a modular construction system that is a hybrid of traditional onsite construction techniques to provide a building structure and offsite manufacturing to provide bespoke facilities in which time to completion and costs are lower than conventional onsite construction techniques.

Certain aspects of the invention provide a versatile modular construction system that allows for a facility to be reconfigured partially or wholly during design, build or subsequent operation rapidly, at low cost and with low impact.

Unless defined otherwise, all technical and scientific terms used herein have the meaning commonly understood by a person skilled in the art to which this invention belongs.

BRIEF DESCRIPTION OF THE DRAWINGS

Embodiments of the present invention will now be described by way of example only with reference to the accompanying drawings where like parts are provided with corresponding reference numerals and in which.

DETAILED DESCRIPTION

Figure 1:
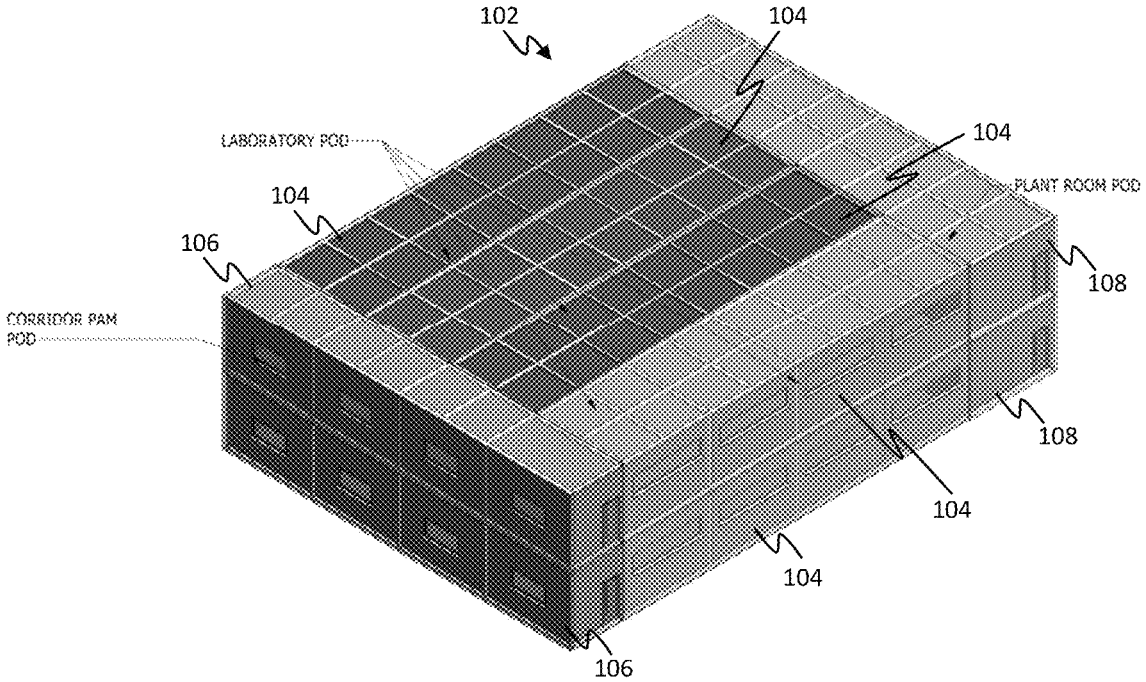
FIG. 1 shows a first embodiment of a laboratory facility.

FIG. 1 shows a first embodiment of a laboratory facility 102 fabricated using a modular building construction system. The laboratory facility 102 comprises a plurality of primary function modules in the form of laboratory pods 104, two transition modules in the form of corridor pods 106 and two support modules in the form of plant room pods 108.

The laboratory pods 104 are arranged in pairs, one above the other. Each pair is arranged adjacent another pair of laboratory pods 104. There are 8 laboratory pods 104 in total.

The two corridor pods 106 are arranged one above the other and are disposed at the ends of the laboratory pods 104 and are configured to allow people, such as laboratory staff, to move between the laboratory pods 104 via the corridor pods 106. Each corridor pod 106 defines a corridor or part of a corridor through which persons can move.

The plant room pods 108 are also arranged one above the other and are disposed at the ends of the laboratory pods 104 opposite the ends at which the corridor pods 106 are disposed. The plant room pods 108 are self-contained with easy access at the side of the laboratory facility 102, and can be configured to accommodate plant machinery that supplies selected other pods. This approach can be used to decentralise systems such as ventilation systems which, in turn, can reduce overall energy consumption. Each plant room pod 108 provides a room or multiple rooms in which services equipment such as plant machinery, for example a heating, ventilation and air conditioning (HVAC) system, may be located.

The facility 102 has a lower first floor (i.e. a ground floor) and an upper second floor, each floor having four laboratory pods 104 connected by a corresponding corridor pod 106, and a plant room pod 108.

Each floor (i.e. the upper and lower floors) is self-contained in the sense that services are supplied from a plant room pod 108 on the same floor. This allows for floors of the facility 102 to be repurposed and reconfigured with negligible impact on other floors.

Figure 2:
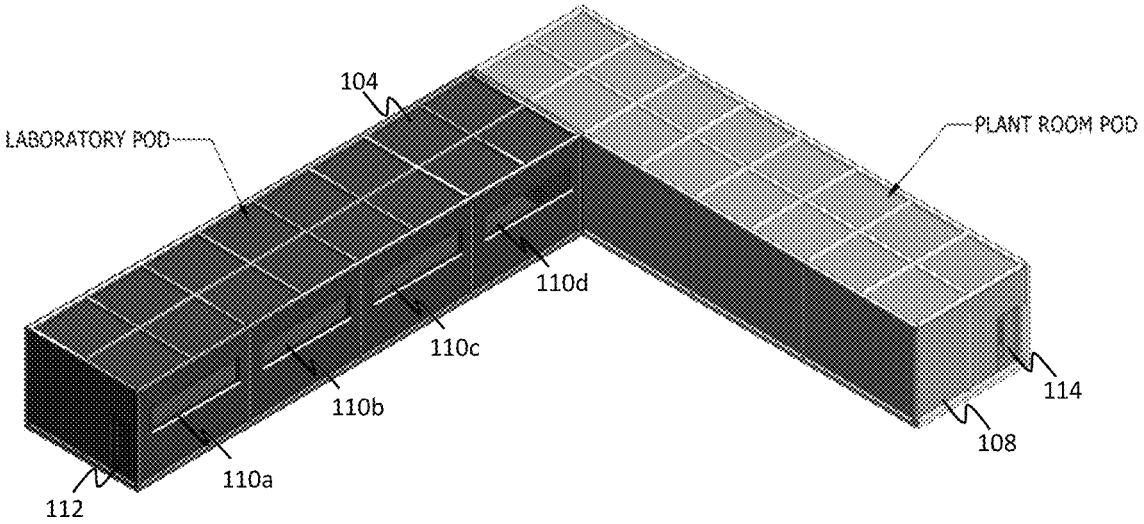
FIG. 2 shows modules of the laboratory facility shown in FIG. 1.

FIG. 2 shows a laboratory pod 104 adjacent a plant room pod 108 of FIG. 1 in isolation. The laboratory pod 104 comprises four windows 110*a*, 110*b*, 110*c*, 110*d* and a door 112 at the end that is adjacent the corridor pod 106. The plant room pod 108 comprises a door 114.

Figure 3:
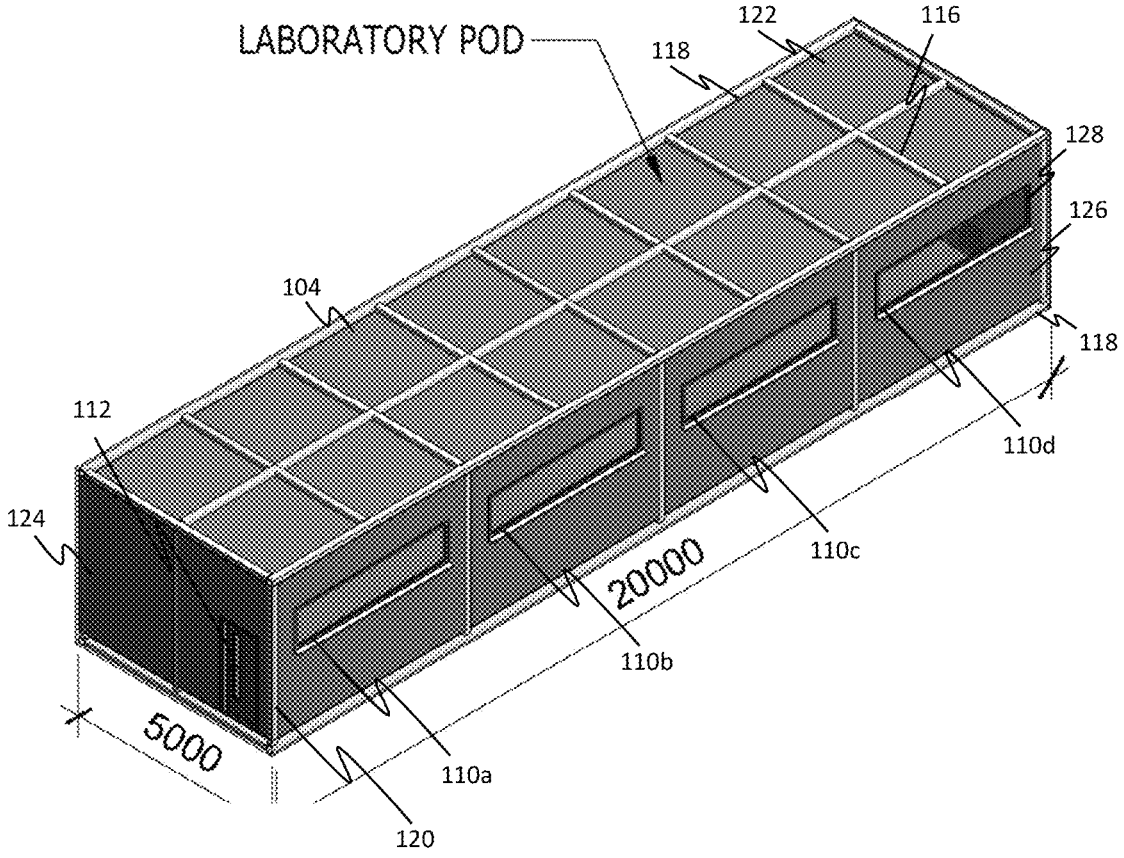
FIG. 3 shows a laboratory module of FIG. 1.

With reference to FIG. 3, each laboratory pod 104 is fabricated from a plurality of beams 116, 118, uprights 120 and panels 122, 124, 126 having standard dimensions. That is to say each beam 116, 118, upright 120 and panel 122, 124, 126 (only one example of each component has been indicated with a reference sign for clarity) has a dimensions, such as length, width and thicknesses, which are not specific to the laboratory pod 104 constructed. The panels 122, 124, 126 may be made of a material certified for a clean-room application and may be resistant to vapourised hydrogen peroxide to allow them to be disinfected using vapourised hydrogen peroxide. Each laboratory pod 104 provides a laboratory room in which laboratory equipment may be disposed.

In the embodiment shown, the laboratory pod 104 has a length off 20 metres (m), a width of 5 metres (m) and a height of 4.2 metres (m), and so is configured to a standard size that can be transported using conventional road haulage.

The laboratory pod 104 is fabricated from twelve uprights 120, five uprights 120 on one side, five uprights 120 on the other side, and one additional upright 120 at each end. Longitudinal beams 118 extend along each side, respectively, both top and bottom. Lateral beams 116 extend laterally from each side beam to a central longitudinal beam. The beams 116, 118 therefore form an open framework having openings between the beams for receiving the panels 122, 124, 126.

Ceiling panels 122 are provided between the lateral beams 116 and the longitudinal beams 118. End panels 124 are provided between the uprights 120 at the ends of the laboratory pod 104. The door 112 is provided in the panel 124 on the right hand side as viewed in FIG. 3. Windowed panels 126 are provided between the uprights 120 along each side of the laboratory pod 104. Each windowed panel 126 has an elongate window 128 provided in it.

Figure 4:
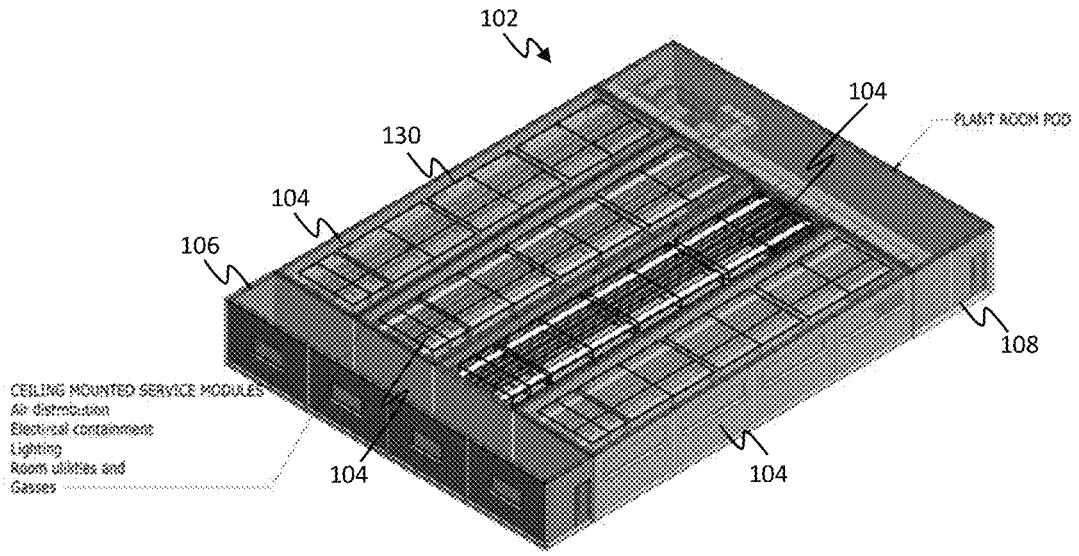
FIG. 4 shows the laboratory facility showed in FIG. 1.

FIG. 4 shows the laboratory facility 102 shown in FIG. 1 with the ceiling panels 122 of the laboratory pods 104, corridor pods 106, and plant room pods 108 absent. Each laboratory pod 104 is provided with a plurality of ceiling mounted service modules 130.

A service module 130 is a prefabricated module that may comprise any one or more ventilation ducts, electrical cable trays, lighting connectors, room utilities and piping for delivery of fluids, particularly gases. Each service module 130 has a preconfigured arrangement and is configured to occupy a space immediately below a ceiling panel 122 or to occupy a space immediately below a plurality of ceiling panels 122 which corresponds to an exact number of ceiling panels 122.

Figure 5:
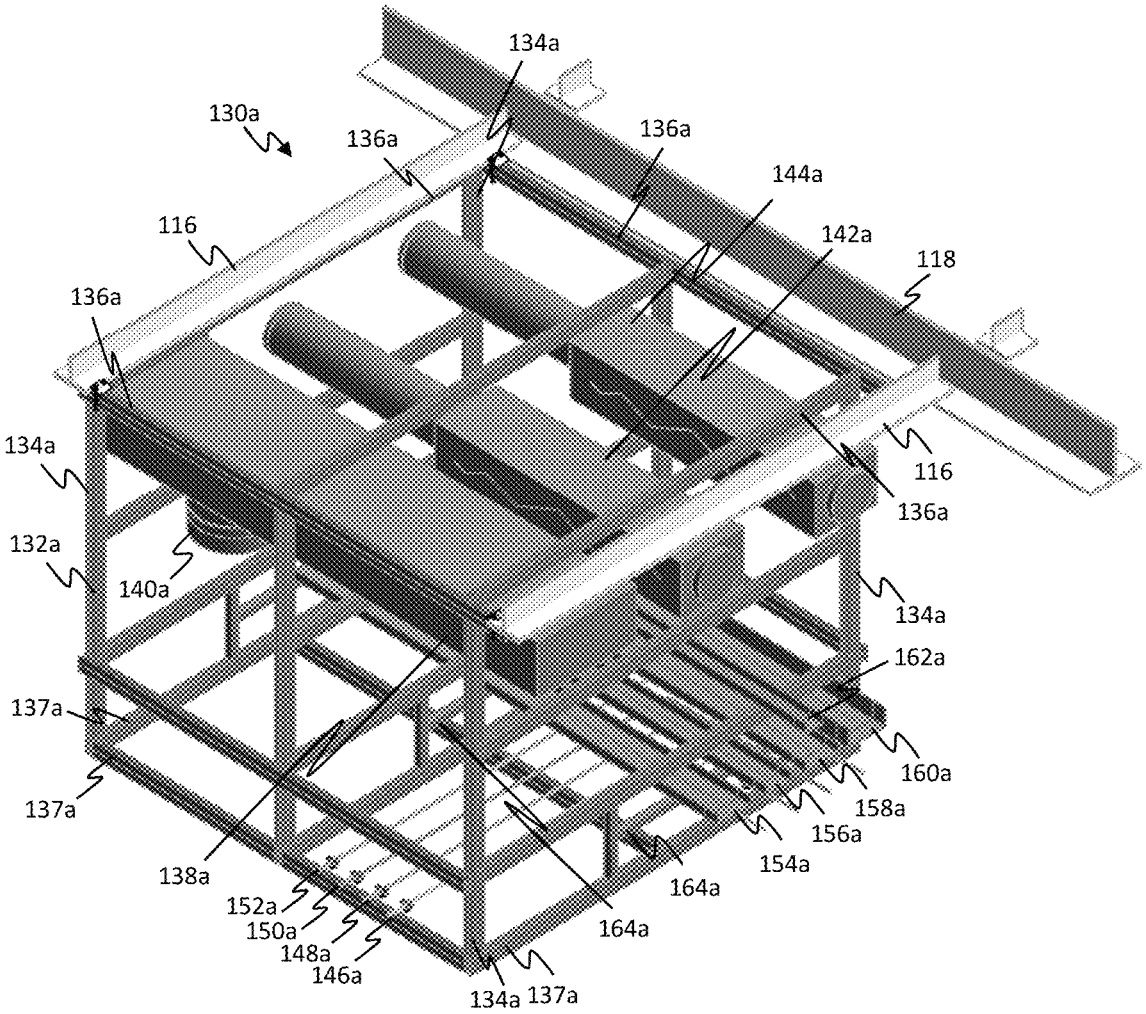
FIG. 5 shows a first embodiment of a services module.

FIG. 5 shows a first embodiment of a service module 130*a*. The service module 130*a* comprises a support framework 132*a* having support uprights 134*a* and upper and lower support beams 136*a*, 137*a*. The support beams 136*a*, 137*a* extend laterally and are connected to the support uprights 134*a* to provide structural rigidity. The support uprights 134*a* and upper and lower support beams 136*a*, 137*a* may comprise met-strut 41×41 or 82×41 configurations which are assembled by welding the met-struts together. Support uprights 134*a* and upper and lower support beams 136*a*, 137*a* may, however, be fabricated for specific loading requirements based on standard British steel sizes which may then be welded or bolted together.

The upper support beams 136*a* are configured to be secured to the lateral beams 116 of the laboratory pod 104 such that the service module 130*a* is suspended below the lateral beams 116. The service module 130*a* has a size and shape which corresponds to the size and shape of ceiling panel 122 and so fits directly under a ceiling panel 122 without protruding laterally from beneath it. This allows service modules 130 to be placed in close proximity to each other under adjacent ceiling panels 122 which, in turn, allows for conveying components such as ventilation ducting, cable trays and piping of adjacent service modules to be connected directly to each other.

A first air supply ventilation duct 138*a* is suspended below the upper support beams 136*a*. The first air supplied ventilation duct 138*a* has a downwardly facing outlet 140*a*.

A second air supply ventilation duct 142*a* is suspended below the upper support beams 136*a* adjacent the first air supply ventilation duct 138*a*.

An air extract ventilation duct 144*a* is also suspended below the upper support beams 136*a* adjacent the second air supply ventilation duct 142*a*.

The ventilation ducts 138*a*, 142*a*, 144*a* are arranged such that they can be connected to ducts of an adjacent service module with which they align. In the present embodiment, each ventilation duct 138*a*, 142*a*, 144*a* comprises a connector at each open end in the form of a flange arrangement that is configured to be directly connected to a corresponding duct of an adjacent service module having a corresponding flange arrangement. For instance, when the services modules are installed, the respective flange arrangements are brought into pressing engagement with each other. The flange arrangements are then held together by clamping means, such as a G-clamp, to provide an air-tight connection. An example of a suitable connector arrangement is a slide-on and crimp flange connector system.

Each ventilation duct 138*a*, 142*a*, 144*a* may comprise one or more of the following features: straight ducting, bend ducting, such as an elbow for changing the direction in which a duct extends, a reducer, manual and/or automatic dampers (which may be electrically, hydraulically or pneumatically actuated), attenuators, heater batteries, temperature transmitters and gas-tight dampers. The ducts may be any suitable configuration including ducts having a rectangular cross-section, circular cross-section, a spiral configuration, or a combination of these depending on requirements. Ducting may also be provided for exhausting specific gases arising from processes.

Fluid supply pipes comprising an oxygen supply pipe 146*a*, a nitrogen supply pipe 148*a*, a compressed air supply pipe 150*a*, and a carbon dioxide supply pipe 152*a* are connected to lower support beams 136*a* such that they extend horizontally. The fluid supply pipes 146*a*, 148*a*, 150*a*, 152*a* are arranged such that they can be directly connected at each of their ends to fluid supply pipes of an adjacent service module with which they align. The fluid supply pipes 146*a*, 148*a*, 150*a*, 152*a* turn through right angles in a horizontal plane as they extend through the service module 130*a*.

There may also be provided supply and return pipes for various services and/or pneumatic systems including low-temperature hot water, reverse osmosis, process cooling water, chilled water, boosted cold water, hot water, water for injection, such as high pressure water and/or natural gas. Each pipe is provided with a connector arranged to connect to a connector of a corresponding pipe in an adjacent services module. Such a connector may comprise a flange connector, threaded connector, welded connection, coupling connector, ferule and Tri-clover™ connector or a press-fit connection depending on requirements and suitability.

The pipes may also comprise bend sections, such as elbows, for changing the direction in which a pipe extends, reducers, valves and/or inline instrumentation. Pipes may be fabricated from suitable materials including stainless steel, such as 304 and 316L, ASME BPE, schedule carbon steel and copper.

Cable trays 154*a*, 156*a*, 158*a*, 160*a*, 162*a* are connected to auxiliary support beams 164*a* that are situated above the lower support beams 137*a* and so provide an intermediate level for supporting the cable trays 154*a*, 156*a*, 158*a*, 160*a*, 162*a*. The cable trays 154*a*, 156*a*, 158*a*, 160*a*, 162*a* are arranged to allow electrical cables to be laid along them and can be aligned with cable trays of an adjacent service module having similarly configured cable trays. The cable trays 154*a*, 156*a*, 158*a*, 160*a*, 162*a* may comprise light, medium and/or heavy-duty cable trays. There may also be provided other cable containment and associated component (s) including ladder rack(s), cable basket(s) and/or cable trunking.

In an alternative embodiment, one or more busbars may be provided to distribute electrical services as an alternative or addition to cables. Such services include, low-voltage and high-voltage distribution, data distribution and retrieval, including communication networks, lighting power distribution, Environmental Monitoring System (EMS) distribution and Building Management System (BMS) distribution. The busbars are arranged such that they are aligned with at least one respective busbar of an adjacent service module such that the busbars of adjacent service modules can be connected directly to each other by a suitable connector such as a busbar end feed connector.

Other electrical components that may be supported by the service module include bends/elbows, tee pieces, reducers, joining plates, junction boxes, end feed units, tap off units, junction blocks, distribution boards, remote ethernet IO modules, control panels.

Figure 6:
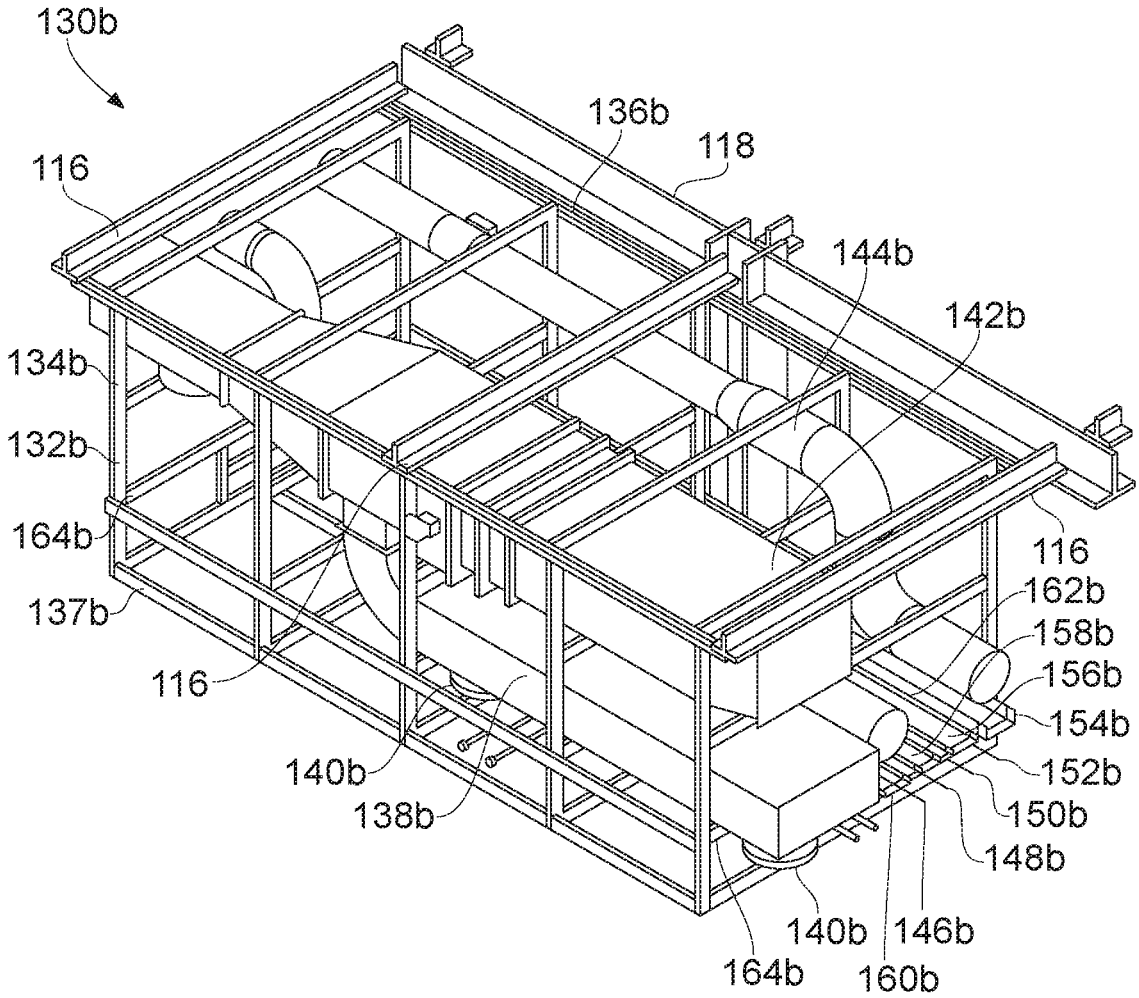
FIG. 6 shows a second embodiment of a services module.
Figure 7:
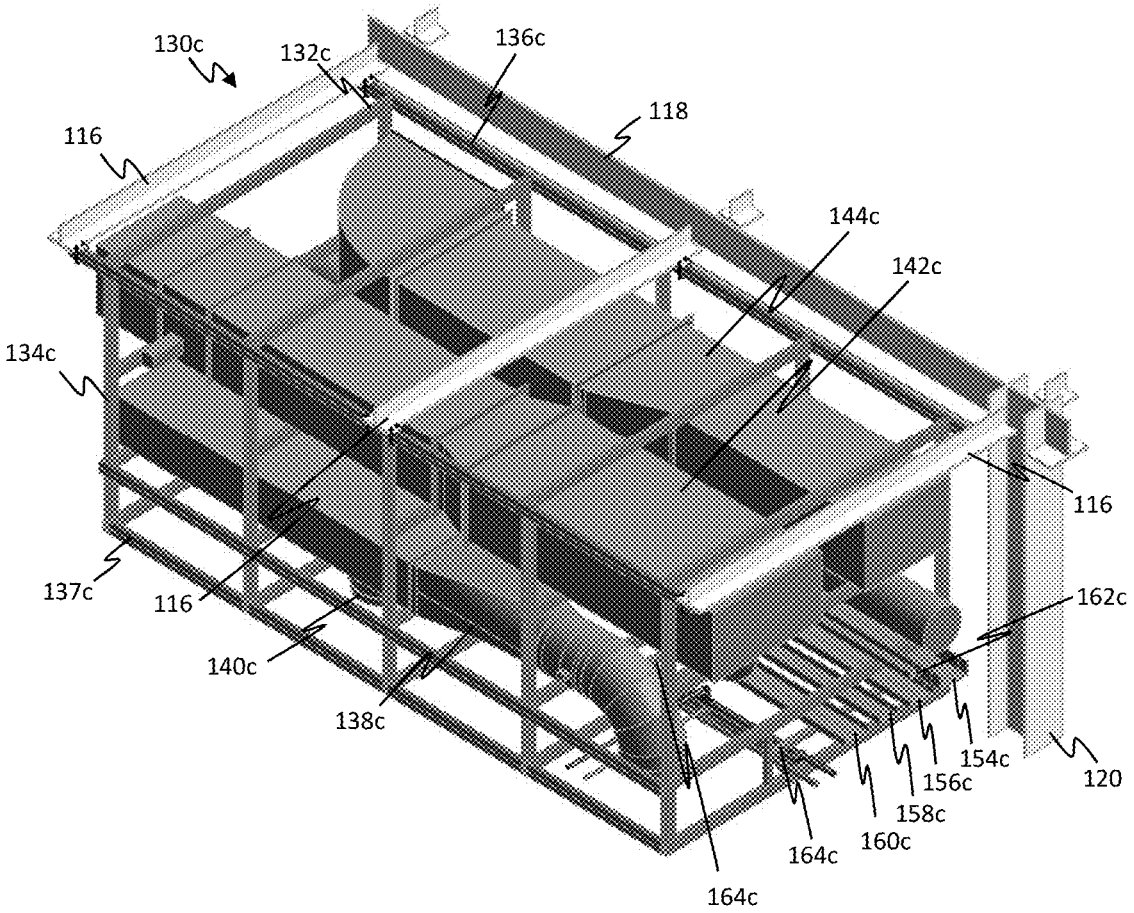
FIG. 7 shows a third embodiment of a services module.
Figure 8:
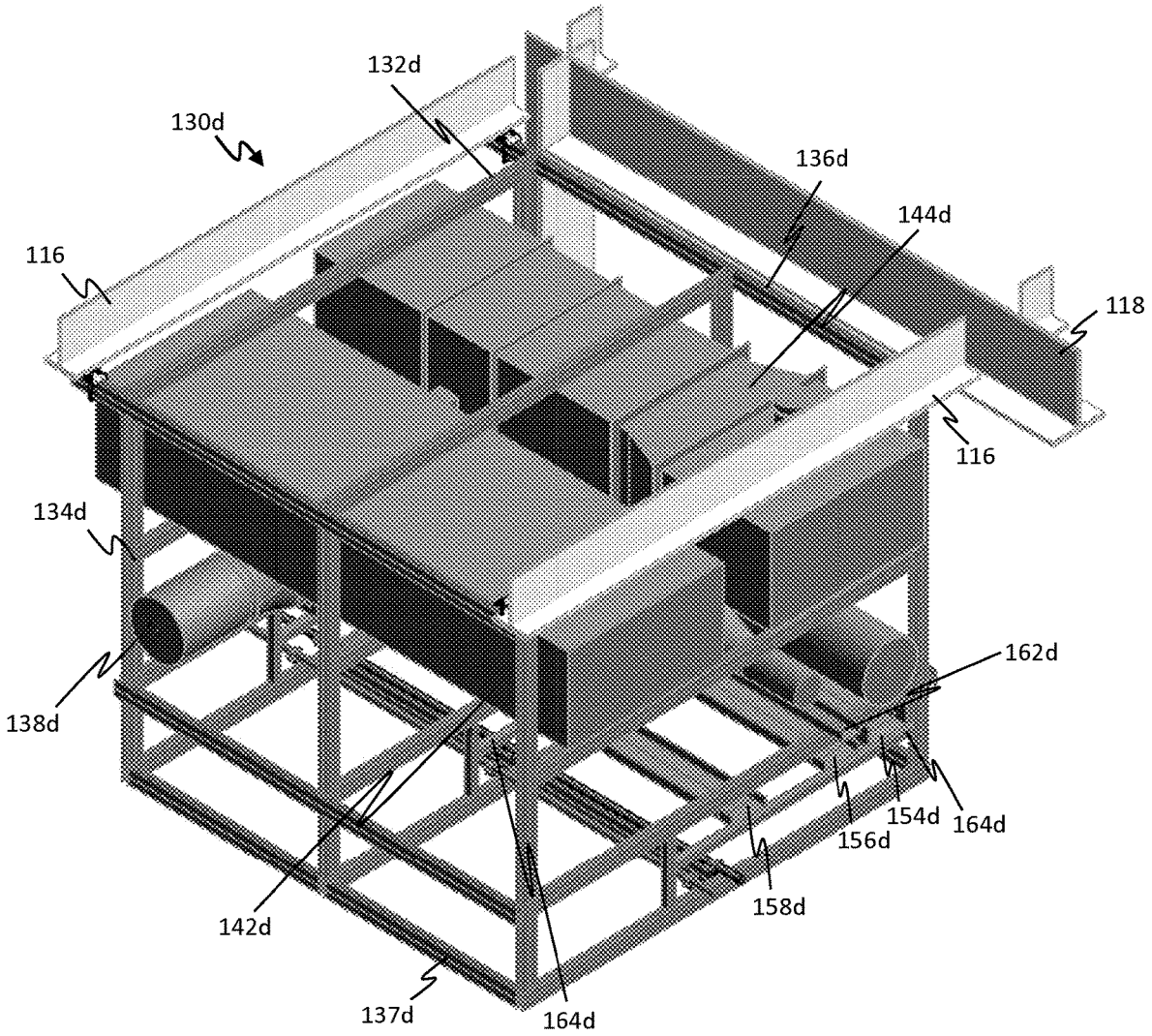
FIG. 8 shows a fourth embodiment of a services module.
Figure 9:
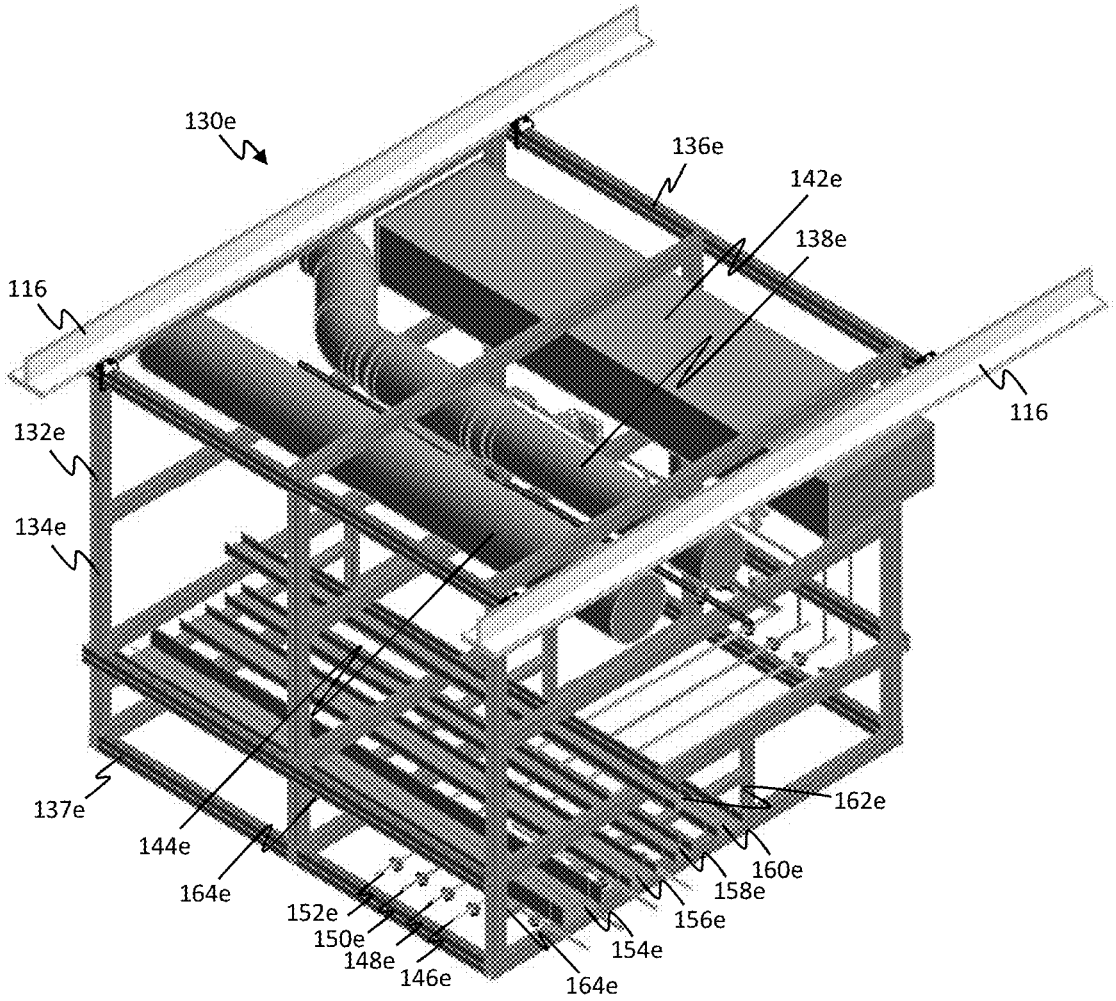
FIG. 9 shows a fifth embodiment of a services module.
Figure 10:
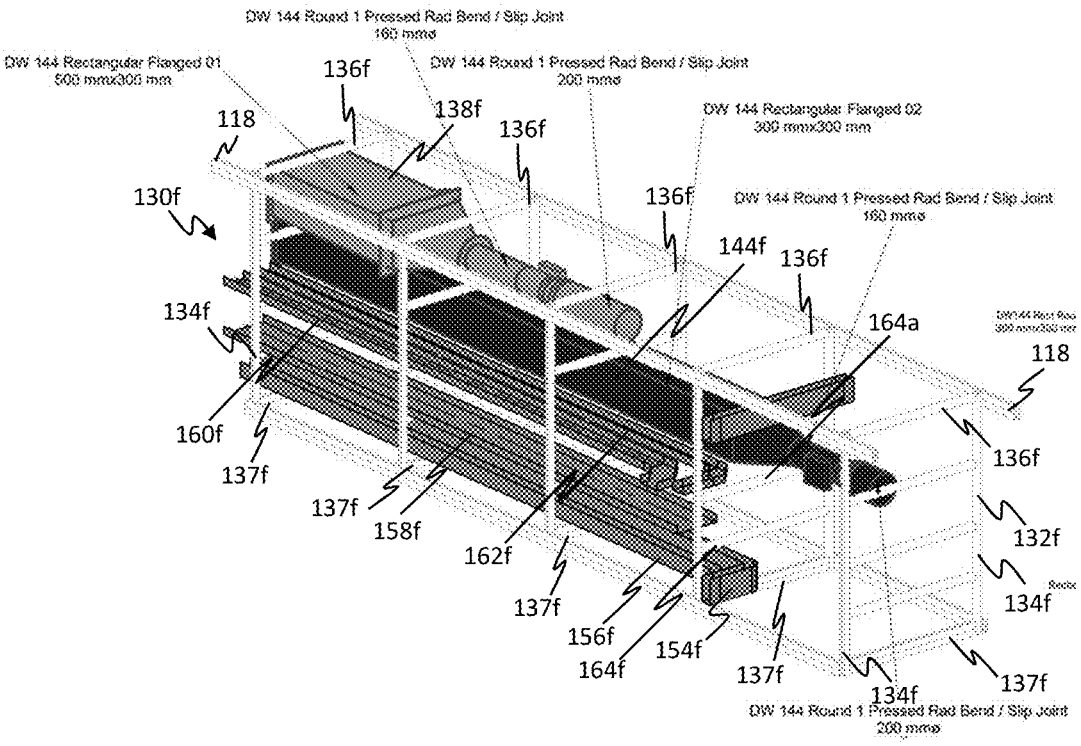
FIG. 10 shows a sixth embodiment of a services module.
Figure 11:
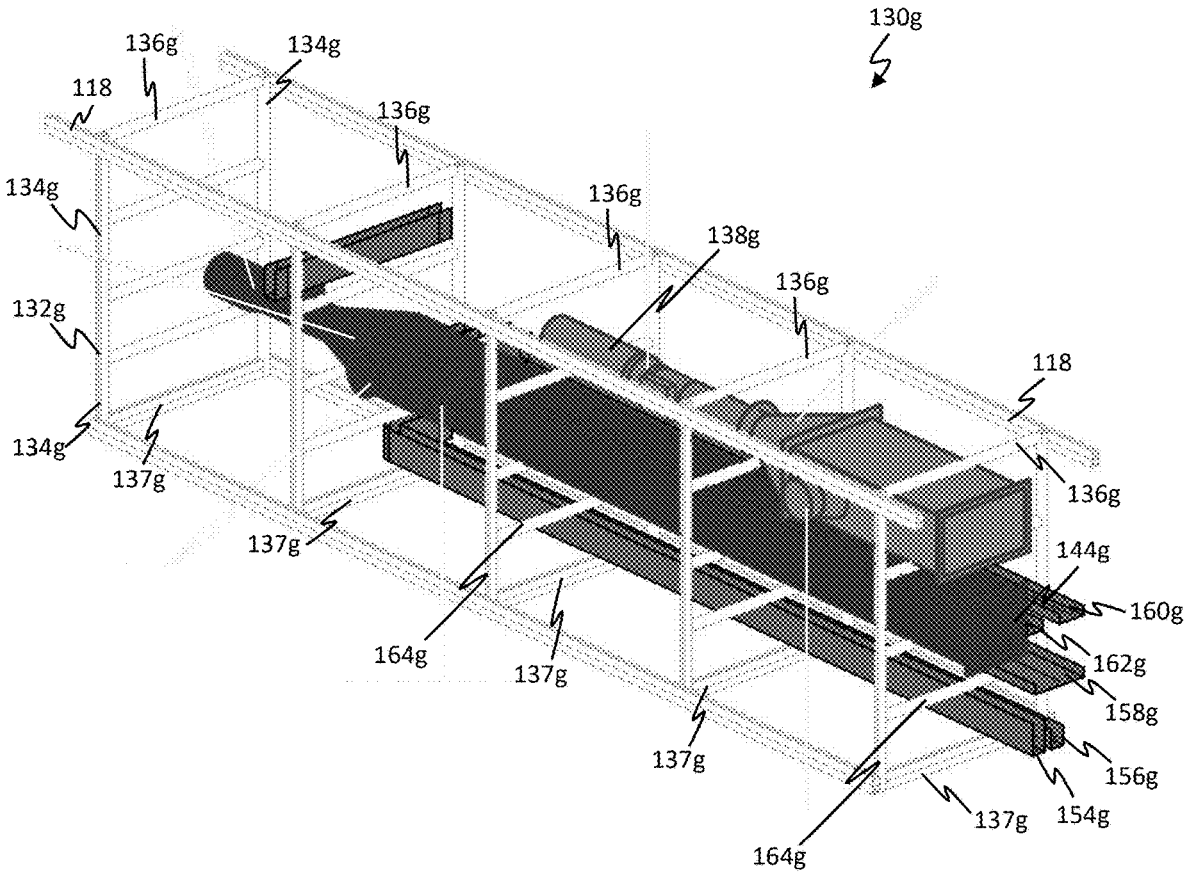
FIG. 11 shows a seventh embodiment of a services module.

FIG. 6 shows a second embodiment of a service module 130*b*. The service module 130*b* is similar to the first embodiment in that it comprises a support framework 132*b* having support uprights 134*b* and upper and lower support beams 136*b*, 137*b*. The support beams 136*b*, 137*b* extend laterally and are connected to the support uprights 134*b* to provide structural rigidity.

The upper support beams 136*b* are configured to be secured to the lateral beams 116 of the laboratory pod 104 such that the service module 130*b* is suspended underneath the lateral beams 116. The support beams 136*b*, 137*b* are approximately double the length of the support beams of the first embodiment of service module 130*a* shown in FIG. 5. The service module 130*b* therefore has a size and shape which corresponds to the size and shape of two adjacent ceiling panels 122 and so fits directly under two adjacent ceiling panels 122 without protruding laterally from beneath them.

A first air supply ventilation duct 138*b* is suspended below the upper support beams 136*b*. The first air supplied ventilation duct 138*a* has downwardly facing outlets 140*b*.

A second air supply ventilation duct 142*b* is suspended below the upper support beams 136*b* adjacent the first air supply ventilation duct 138*b*.

An air extract ventilation duct 144*b* is also suspended below the upper support beams 136*a* adjacent the second air supply ventilation duct 142*b*.

The first air supply ventilation duct 138*b* extends longitudinally within the service module 130*b*. The second air supply ventilation duct 142*b* and the air extract ventilation duct 144*b* are configured to bend within the service module 130*b* such that the ends of the ducts 142*b*, 144*b* are at different height within the service module 130*b*. The ducts 138*b*, 142*b*, 144*b* are arranged such that they can be connected to ducts of an adjacent service module with which they align.

Fluid supply pipes comprising an oxygen supply pipe 146*b*, a nitrogen supply pipe 148*b*, a compressed air supply pipe 150*b*, and a carbon dioxide supply pipe 152*b* are connected to lower support beams 136*b* such that they extend horizontally. The fluid supply pipes 146*b*, 148*b*, 150*b*, 152*b* are arranged such that they can be connected at each of their ends to air supply pipes of an adjacent service module with which they align. The fluid supply pipes 146*b*, 148*b*, 150*b*, 152*b* extend longitudinally within the service module 130*b*.

Cable trays 154*b*, 156*b*, 158*b*, 160*b*, 162*b* are connected to auxiliary support beams 164*b* that are situated above the lower support beams 137*b*. The cable trays 154*b*, 156*b*, 158*b*, 160*b*, 162*b* are arranged to allow electrical cables along them and can be aligned with cable trays of an adjacent service module having similarly configured cable trays.

It will be appreciated that a service module 130 may be configured to a desired specification. The service modules may have predefined standard unit widths, lengths and heights. The widths and lengths may vary between service modules, but do so in predefined increments that correspond to a unit width. For example, the first embodiment of a service module 130*a* (shown in FIG. 5) which occupies the space under a single ceiling panel 122 may be considered to have a single unit width and a single unit length. The second embodiment of a service module 130*b* (shown in FIG. 6) which occupies the space under two ceiling panels 122 may be considered to have a single unit width and a double unit length.

FIGS. 7, 8, 9, 10 and 11 show third, fourth, fifth, sixth and seventh embodiments of a service module 130*c*, 130*d*, 130*e*, 130*f*, 130*g*.

The third embodiment 130*c* has a unit width and a double unit length. The fourth and fifth embodiments 130*d*, 130*e* have a single unit width and a unit length. The fifth and embodiments 130*f*, 130*g* have a single unit width and a quadruple unit length.

Each embodiment 130*c*, 130*d*, 130*e*, 130*f*, 130*g* has components that correspond to at least some of the components of the first and second embodiments 130*a*, 130*b*. The components take the same reference numbers with the relevant letter for each embodiment. The embodiments illustrate how the various components may be arranged in accordance with a specification. For example, cable trays may be arranged two extend perpendicularly with respect to each other or to have bends in them.

The system provides a means by which ducting, cable, pipes and connectors can be preassembled in modules in accordance with a desired layout whereupon the service modules when connected to a laboratory pod 102 follow a desired layout. Multiple service networks can therefore be installed in a predetermined layout by installing the preassembled service modules. This allows for a substantially proportion of the network to be assembled remotely from the building in which it is to be installed and provides a significant reduction in installation time on-site.

By providing ceiling mounted service modules 130, ready access is provided to services from above through the ceiling of the laboratory pod 102, such as cables, piping and ducting, which greatly reduces the time taken for installation of services (e.g. traditional first and second 'fix' services) and commissioning.

Figure 12:
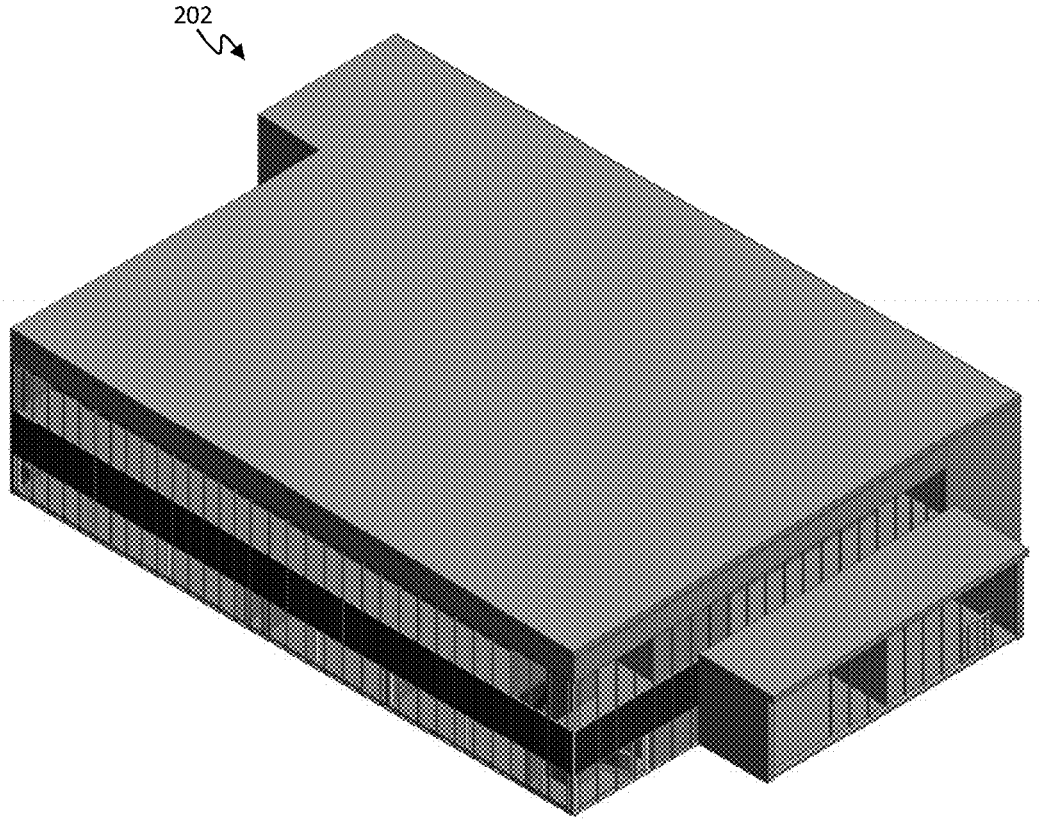
FIG. 12 shows a second embodiment of a laboratory facility.

FIG. 12 shows a second embodiment of a laboratory facility 202 fabricated using a modular building construction system. The facility 202 is a hybrid arrangement fabricated using a combination of conventional building techniques and a modular building construction system.

Figure 13:
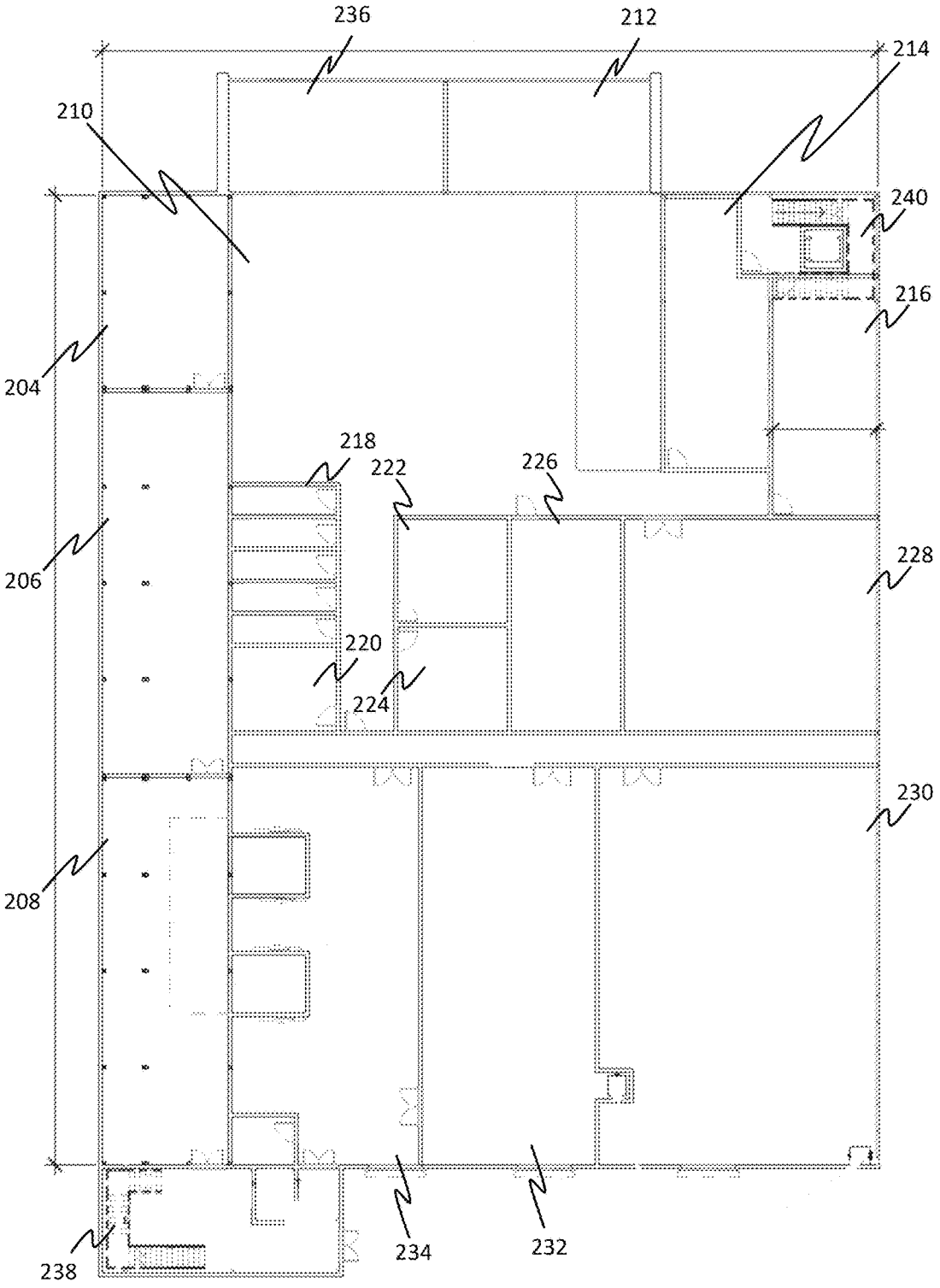
FIG. 13 shows a layout of a first floor the laboratory facility shown in FIG. 12.

FIG. 13 shows a layout of a first floor (the ground floor) of the laboratory facility 202 shown in FIG. 12. The first floor of the laboratory facility 202 comprises three support modules in the form of first, second and third plant room pods 204, 206, 208 which are positioned adjacent a conventional building structure 203.

The conventional building structure 203 includes an office room 210, which provides office space, a reception space and also a dedicated space preparing food and beverages, each of which may be sub-divisions of the office room 210; a break out room 212, which provides an informal meeting space annexed to the office room 210; a male change room 214, which provides a space for male personnel to change attire; a female change room 216, which provides a space for female personnel to change attire; a water closet room 218, which is subdivided to provide individual toilet cubicles; a computer hardware room 220, which provides a space for accommodating computer hardware; first, second and third meeting room 222, 224 226, which provide private meeting spaces; a conferencing room 228, which provides a conferencing space; a consumables room 230, which provides a storage facility for consumables used in the laboratories such as bottles, carboys, centrifuge tubes, vials slides and petri dishes and which may be transferred to the laboratories as required; a sample delivery room 232, which is where specimens are delivered, catalogued and stored awaiting testing in the laboratories; and an autoclave and waste out room 234, in which waste from laboratories is sorted and stored, and in which re-useable utensils are processed and sterilised using an autoclave washer before being catalogued to the consumables room 230.

The conventional building structure 203 also includes an entrance room 236, a first stairwell 238 and a second stairwell 240.

Figure 14:
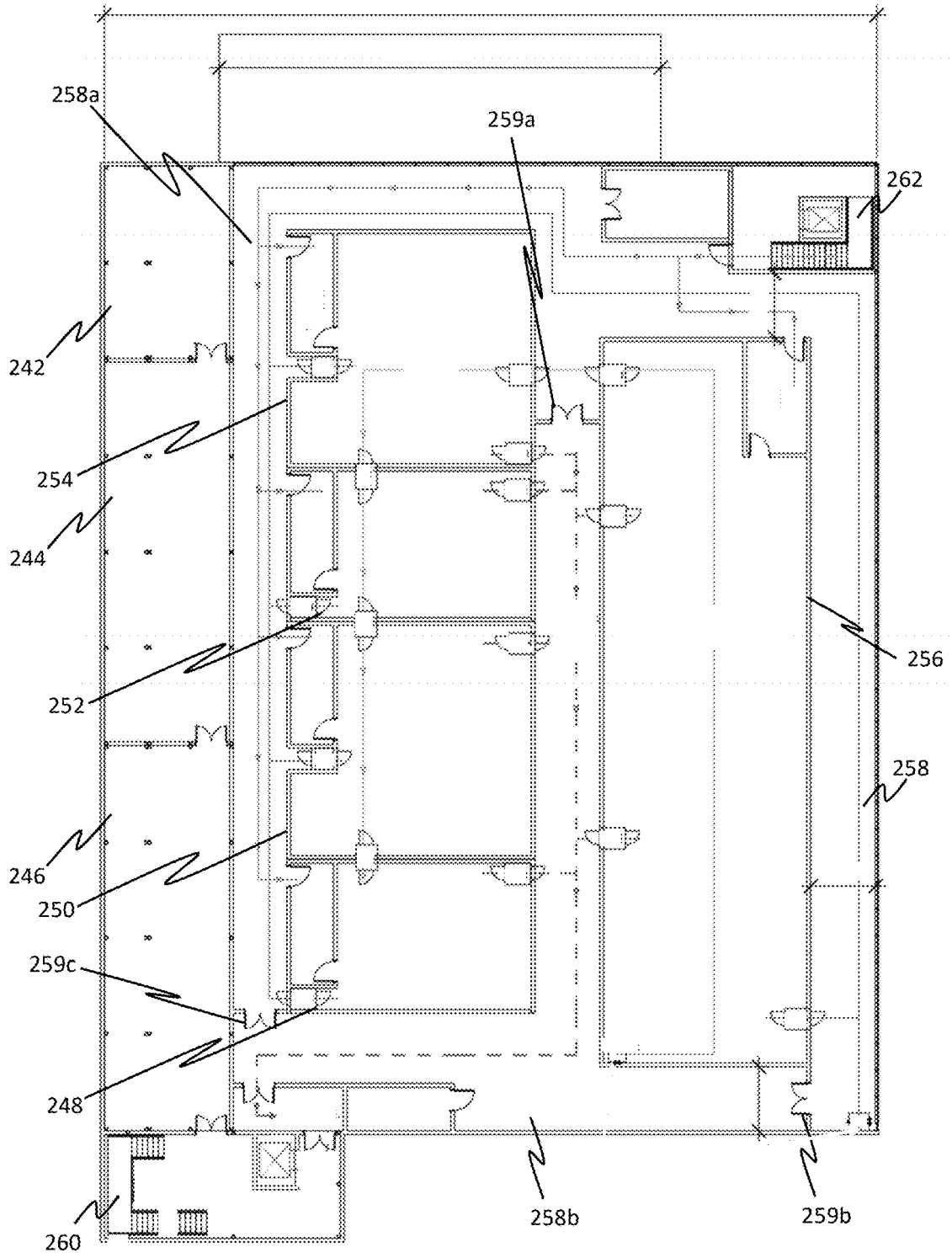
FIG. 14 shows a layout of a second floor of the laboratory facility shown in FIG. 12.

FIG. 14 shows a layout of a second floor (an upper floor) of the laboratory facility 202 shown in FIG. 12. The second floor of the laboratory facility 202 comprises three support modules in the form of fourth, fifth and sixth plant room pods 242, 244, 246 which are positioned adjacent the building structure 203 and above the first, second and third plant rooms 204, 206, 208.

The second floor of the conventional building structure 203 includes first, second, third, fourth and fifth laboratory rooms 248, 250, 252, 254, 256. Each laboratory room 248, 250, 252, 254, 256 is subdivided into a gowning space and a laboratory space.

The conventional building structure 203 also comprises a first corridor 258 which extends around the laboratory rooms 248, 250, 252, 254, 256 and also has a portion which extends between the first, second, third and fourth laboratory rooms 248, 250, 252, 254, which are positioned in a line adjacent one another, and the fifth laboratory room 256. The corridor 258 is subdivided by three doors 259*a*, 259*b*, 259*c* to form an 'entrance' corridor 258*a* and an 'exit' corridor 258*b*.

The conventional building structure 203 also comprises a third stairwell 260, which is disposed directly above and adjoins the first stairwell 238 to form a single stairwell between the first and second floors, and a second stairwell 262 which is disposed directly above and adjoins the second stairwell 240 to form a single stairwell between the first and second floors.

Each plant room pod is fabricated using uprights, longitudinal and lateral beams, and panels having standard configurations such as those used in the fabrication of the laboratory pod 104 described with reference to FIG. 3, and is equipped with service modules, as required.

The plant room pods 204, 206, 208, 242, 244, 246 may be assembled off-site away from the conventional building structure 203 before being transported to the building location and located in position adjacent the conventional building structure 203, as shown in FIGS. 13 and 14. Once in position the plant room pods 204, 206, 208, 242, 244, 246 are joined with the conventional building structure and clad with a suitable cladding system that is the same as the cladding system used for the conventional building structure 203 so as to create the appearance of an integrated facility 202.

Figure 15:
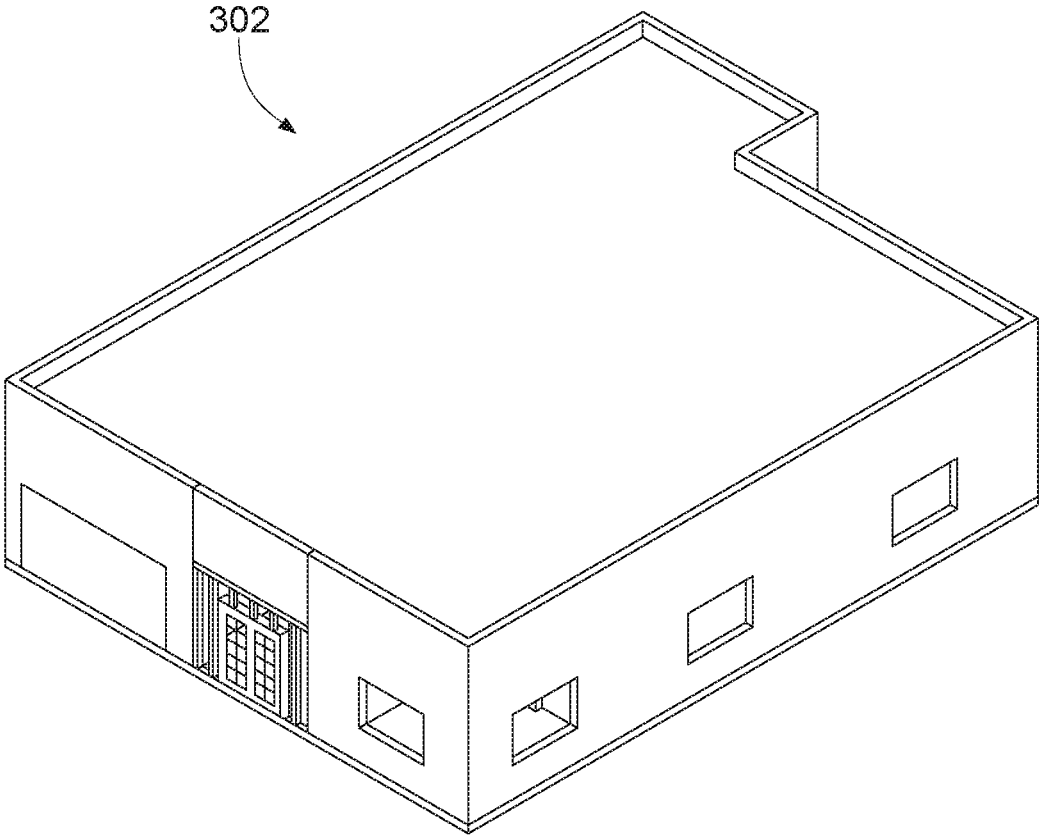
FIG. 15 shows an embodiment of a facility.
Figure 16:
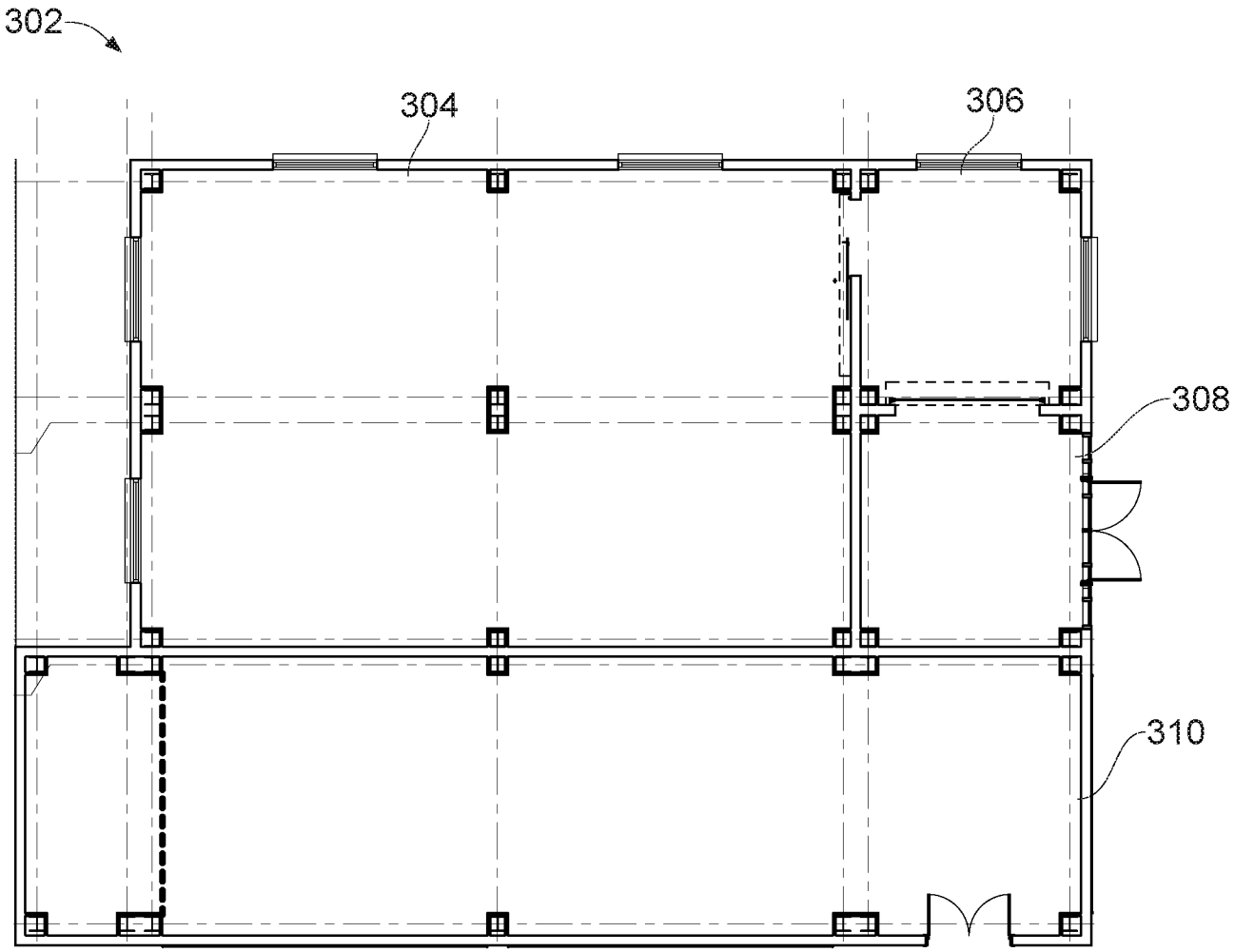
FIG. 16 shows a layout of the facility shown in FIG. 15.

FIGS. 15 and 16 show a facility having a single primary function module in the form of a dry room pod 304; two transition modules in the form of an air lock module 306 and a lobby module 308; and a support module in the form of a plant room pod 310. Each pod is fabricated using uprights, longitudinal and lateral beams, and panels having standard configurations such as those used in the fabrication of the laboratory pod 104 described with reference to FIG. 3, and is equipped with service modules, as required.

The modular building construction system may be used for a range of applications including the fabrication of medical, research and manufacturing facilities. For example, the modular building construction system may be used to construct vaccine development facilities, cell gene therapy facilities and advanced therapy medicinal product facilities.

Buildings may use heat recovery, heat pumps and integrated solar panels to reduce or eliminate carbon dioxide emissions. The modular building construction system may reduce the amount of space (area) required for a plant room by 50% or more.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" or "comprising" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

It will be appreciated that various embodiments of the present disclosure have been described herein for purposes of illustration, and that various modifications may be made without departing from the scope of the present disclosure. Accordingly, the various embodiments disclosed herein are not intended to be limiting, with the true scope being indicated by the following claims.

The invention claimed is:

1. A modular building construction system for fabricating a facility comprising:

a plurality of primary function modules, each primary function module configured to house equipment for a primary function;

at least one transition module configured to cooperate with at least two of the plurality of primary function modules in order to allow people to move from at least one of the primary function modules to at least one other of the primary function modules via the transition module, and a support module configured to house equipment for supporting the primary function modules and the at least one transition modules, wherein each primary function module includes multiple preassembled service modules mounted inside the primary function module, each one of said preassembled service modules includes a support framework, at least one of ventilation ducting, an electrical cable tray, and piping for supply of at least one fluid to the primary function module, and wherein said ventilation ducting, said electrical cable tray, and said piping are preassembled into the preassembled service module and are configured such that said ventilation ducting, said electrical cable tray, and said piping of one of the service modules mounted in said primary function module can be connected to ventilation ducting, cable tray, and piping of an adjacent service module mounted in said primary function module.

2. The modular building construction system of claim 1, wherein each primary function module comprises a framework having a plurality of openings and which is configured to provided structural rigidity for the primary function module.

3. The modular building construction system of claim 2, wherein each primary function module further comprises panels which attach to the framework and are configured to occlude the openings in the framework.

4. The modular building construction system of claim 3, wherein the framework comprises lateral beams configured such that the preassembled service module is secured to the lateral beams such that it is suspended from the lateral beams.

5. The modular building construction system of claim 1, wherein the primary function modules are configured to be stacked one above the other.

6. The modular building construction system of claim 1, wherein each primary function module is a laboratory module.

7. The modular building construction system of claim 1, wherein the support module is plant room module configured to house plant machinery.

8. The modular building construction system of claim 7, wherein the plant machinery comprises a heating, ventilation and air conditioning (HVAC) system.

9. The modular building construction system of claim 8, wherein the heating, ventilation and air conditioning (HVAC) system is a once-through heating, ventilation and air conditioning (HVAC) system having heat recovery.

10. The modular building construction system of claim 1, wherein each module has a length not greater than 20 m, a width not greater than 5 m and a height not greater than 4.2 m.

11. A facility comprising:

a plurality of primary function modules, each primary function module is configured to house equipment for a primary function;

at least one transition module connected with at least two of the plurality of primary function modules such that people are able to move from at least one of the primary function modules to at least one other of the primary function modules via the transition module, and a support module configured to house equipment for supporting the primary function modules and the at least one transition modules, wherein each primary function module includes multiple preassembled service modules mounted inside the primary function module, each one of said preassembled service modules includes a support framework, at least one of ventilation ducting, an electrical cable tray, and piping for supply of at least one fluid to the primary function module, and wherein said ventilation ducting, said electrical cable tray, and said piping are preassembled into the preassembled service module and are configured such that said ventilation ducting, said electrical cable tray, and said piping of one of the service modules mounted in said primary function module can be connected to ventilation ducting, cable tray, and piping of an adjacent service module mounted in said primary function module.

12. The facility of claim 11, wherein the facility comprises:

a first floor having at least one primary function module, at least one transition module and at least one support module which houses equipment arranged to support the at least one primary function module and the at least one transition module, and a second floor having at least one primary function module, at least one transition module and at least one support module which houses equipment arranged to support the at least one primary function module and the at least one transition module.

13. The facility of claim 11, wherein the preassembled service module is not greater than 6 m in length.

14. A method of assembling a facility comprising the steps:

providing a plurality of primary function modules, each primary function module configured to house equipment for a primary function;

connecting at least one transition module with at least two of the plurality of primary function modules in order to allow people to move from at least one of the primary function modules to at least one other of the primary function modules via the transition module, and connecting at least one support module configured to house equipment for supporting the primary function modules and the at least one transition modules to at least one of the primary function modules and/or the at least one transition module, mounting multiple preassembled service modules inside each one of the primary function modules, said preassembled service module includes a support framework, at least one of ventilation ducting, an electrical cable tray, and piping for supply of at least one fluid to the primary function module, and connecting said ventilation ducting, said electrical cable tray, and said piping of a service module mounted in said primary function module to ventilation ducting, cable tray, and piping of an adjacent service module mounted in said primary function module.

15. The method of claim 14, wherein each of the primary function modules, the at least one transition module and the at least one support module is fabricated remotely from a site at which the facility is assembled, and subsequently transported to the site for assembly with the other of said primary function, transition and support modules.

* * * * *